United States Patent [19]

Christensson

[11] Patent Number: 4,736,870

[45] Date of Patent: Apr. 12, 1988

[54] POWDER PROOF RECLOSABLE CONTAINER

[75] Inventor: Lars Christensson, Bromma, Sweden

[73] Assignee: Akerlund & Rausing Licens Aktiebolag, Jarfalla, Sweden

[21] Appl. No.: 57,803

[22] Filed: Jun. 3, 1987

[30] Foreign Application Priority Data

Jun. 5, 1986 [SE] Sweden ..... 8602553
Feb. 12, 1987 [SE] Sweden ..... 8700571

[51] Int. Cl.[4] ..... B65D 90/04

[52] U.S. Cl. ..... 220/461; 220/410; 220/307

[58] Field of Search ..... 220/258, 403, 404, 408, 220/410, 461, 462, 463

[56] References Cited

U.S. PATENT DOCUMENTS

| | | | |
|---|---|---|---|
| 3,058,642 | 10/1962 | Hester | 220/461 |
| 3,459,357 | 8/1969 | Egger et al. | 220/462 |
| 4,459,793 | 7/1984 | Zenger | 220/461 |
| 4,466,553 | 8/1984 | Zenger | 220/461 |

*Primary Examiner*—George T. Hall
*Attorney, Agent, or Firm*—James E. Nilles

[57] ABSTRACT

A powder proof, reclosable container, for instance, a container which is powder, liquid and gas or steam proof before being opened and which, after having been opened, is adapted for being reclosed under powder, liquid, gas or steam tight conditions, and comprising an outer container (1) of a supporting material, an inner bag (2) or an inner layer of, for instance, a liquid or gas proof material and a reclosable lid means (3) comprising a lid frame (11) and a closing lid (12) which may be hinge connected to said lid frame, and in which the inner bag (2) or the inner layer is sealingly connected to the lid frame (11). The lid frame is around the frame opening (15) formed with an even bottom surface (10) of such width that the inner bag (2) or a sealing foil can be sealingly connected to said edge (10), and the lid frame (11) and the closing lid (12) can be formed with cooperating means, for instance, bevelled edges, for providing a powder, liquid, gas or steam tight reclosing of the container.

18 Claims, 6 Drawing Sheets

POWDER PROOF RECLOSABLE CONTAINER

BACKGROUND OF THE INVENTION

The present invention generally relates to a reclosable package or container which is powder, liquid, gas or steam proof before being opened and which, after having been opened, is adapted for being reclosed to become at least powder tight and preferably liquid, gas or steam tight.

Such reclosable packages or containers comprise an outer container sleeve of a supporting material, an inner bag or an inner layer on said container sleeve of a powder, liquid, gas or steam proof material and a reclosable lid means comprising a lid frame adapted to be connected to the container sleeve and a closing lid adapted to be connected to the lid frame.

For a reclosable container of the above described type, it is desirable that the container be powder, liquid and gas or steam proof before the container has been initially opened, and that the container can, thereafter, be reclosed at least so as to be powder tight; so that no gas-way appears between the outer container, which is generally not sealed, and the inner bag; and so that the content of the container cannot enter any possible spaces between the inner bag and the reclosable lid means. This requirement is especially important for goods which may be destroyed by the action of the oxygen of the air, for instance food stuffs like coffee, tea and many other products.

Packages or containers of this general type are known for instance from applicant's German Pat. No. 1,511,087, which patent discloses a container in which the inner bag is connected to the inner surface of the cardboard outer container and is formed with an end closure foil, and in which a reclosable lid means is formed with a join-channel into which the evenly cut upper edges of the outer container and the inner bag are introduced and secured.

Applicant's Swedish Pat. No. 77 00806-8 discloses a similar type of container in which the inner powder, liquid, and gas or steam proof bag is likewise connected to the cardboard outer container adjacent the upper edge thereof, and whereby the container is adapted for being provided with a separate reclosing lid.

Both types of containers while generally satisfactory in performance could be made even more functional for continued storage and protection of the material therein after the container has been initially opened by providing a high efficiency seal for the reclosable lid means. In addition, such prior art containers could be further improved so that the content of the containers, which may be a liquid, a powder or a granular material, etc., will not be able to penetrate into the area between the inner bag and the cardboard outer container.

Another known type of container comprises a container sleeve made of a blank of cardboard material, which at least on the inner surface is covered with a weldable layer of material, preferably a high frequence weldable material, and in which the container sleeve at the bottom thereof is closed by means of a cup-formed foil or a cup-formed lid piece having a weldable layer of material facing the interior of the container and facing the walls of the sleeve. The cup-formed piece is introduced in the container sleeve and is secured to the walls thereof, for instance by high frequence weld connecting the two layers of material facing each other.

In the manufacture of such a container a sleeve is prepared, formed with a bottom and is filled with the intended goods, whereupon a lid piece is pressed into said sleeve by means of a press plunge. In such containers it is preferable that a plain lid blank is pressed down through a formation ring provided around the opening of the sleeve, whereby the lid blank is automatically formed with upwardly extending rims as it is pressed down into a cup-shaped lid piece. After the cup-shaped lid piece has been introduced in the container tube the folded up rims thereof are weld connected to the layer on the inner surface of the sleeve. A container of this type can easily be made powder, liquid, gas or steam proof, and it is well suited for packing of all kinds of solid and liquid goods, for instance food stuffs. When the container is opened a part of the lid piece is cut or torn open, and the packed goods can be poured out or can be portioned out.

For such goods which are successively consumed the container is provided with a detachable reclosing lid. A container of the above mentioned type may in some cases, especially in case of relatively thin container sleeves, be considered relatively weak, and the upper edge can be damaged after repeated reclosing of the detachable reclosing lid. In such a case it would be advantageous that the reclosing lid cooperates with an edge frame of stiff material, and it would likewise be advantageous that the reclosing lid be inseparably connected to the container or to such stiff edge frame.

SUMMARY OF THE INVENTION

The object of the invention therefore has been to solve the problem of providing a container which is powder, liquid and gas or steam proof before being opened, and which, after having been opened, can be reclosed by means of a reclosable lid means which is separate or hinge connected to the container, so that the container again becomes powder tight or preferably even relatively liquid, gas or steam tight. The container comprises a container sleeve having an inner bag or layer of material of a powder, liquid, gas or steam proof material, and a reclosable lid means consisting of a lid frame which can be applied to the container sleeve and a separate or hinge connected reclosing lid which can be connected to the lid frame. The inner bag or layer of the tube is tightly connected in powder, liquid, gas or steam proof relation to said lid frame, and the lid can be reconnected to the lid frame under at least powder tight and preferably liquid, gas or steam tight conditions after the container has been opened.

For this purpose it is required first that the inner bag is powder, liquid, gas or steam proof; second that the reclosable lid means has a good sealing property; and third that the reclosable lid means is sealed against the inner bag.

In a first preferred embodiment of the invention wherein an inner bag is utilized, said inner bag and the cardboard outer container can be completely or partly separate from each other but both are fixedly connected to the reclosable lid means. More specifically, the cardboard outer container is connected in sealed relation to an edge frame of the reclosable lid means, and the inner bag is connected in sealed relation to an even bottom surface which is provided for this purpose on the edge frame. Further, the edge frame of the reclosable lid means is formed with a preferably bevelled, conical or otherwise formed inner sealing surface, and the lid part, at the bottom surface thereof, has a correspondingly formed flange, which seals tight against the inner sealing surface of the edge frame when the lid is closed.

In addition to the advantage of obtaining a container which is powder, liquid and gas or steam proof before being opened and after having been opened is reclosable to be at least powder tight, the advantage is also obtained that the edge frame and the inner bag, which may partly consist of resin and metal, can be separated from the outer container, which can be made completely of cardboard or any other easily combustible, moulderable or reusable material.

In a second preferred embodiment of the invention, in which the cardboard sleeve has a powder, liquid, gas or steam proof layer of material on the inner side thereof, the container is closed to be powder, liquid, gas or steam proof by means of a closing foil which is welded or otherwise tightly secured to the inner layer of material of the container sleeve, and the lid frame is directly or indirectly in powder, liquid, gas or steam proof relation to the closing foil. This sealing connection can be made, for instance, by attaching the closing foil to an even bottom surface of the edge frame, and by making said foil larger than the opening of the container sleeve so that it will present edges that extend freely a distance transversely beyond the edge frame. Thus when the foil is introduced with the reclosing lid into the container sleeve, or when pressing same through a formation ring on the container sleeve, the edges thereof will automatically be folded up and pressed into contact with the weldable inner layer of the container sleeve, whereupon the folded up edges or rims of the foil are then sealingly connected to the inner surface of the tube. A manufacturing-technical advantage with the invention is that it is possible to preassemble the reclosing lid and edge frame with the closing foil attached thereon as a unit ready for insertion into the container. This preassembled unit can be used as a press plunge for direct introduction in the container sleeve.

Alternatively, a closing foil and a reclosing means are used which are separate from each other but which are introduced in the sleeve and are weld connected in one and the same operation.

It is also possible to connect the closing foil to the inner surface of the sleeve in a first step and to connect the edge frame to the sealing rim of the closing foil in a second step, or to connect both the closing foil and the edge frame to the inner surface of the container sleeve on different levels, whereby the seal between the reclosing means and the closing foil is obtained using a part of the gas tight inner layer of the sleeve.

The connection can be made by means of glue, but preferably it is made by welding, for instance high frequence welding.

For opening of the container the reclosing lid is folded up, and the closing foil is cut or torn open, for instance by means of any known type of tear-open means, whereby the edge frame still remains connected in sealed relation to the inner surface of the container tube. Modern reclosing lids having edge frames, for instance of a plastic material, can, in accord with the present invention, be formed so tight that they, upon reclosing, become not only powder tight but even liquid, gas or steam tight, whereby the container as a whole becomes steam proof.

Further characteristics of the invention will be evident from the following detailed description in which reference will be made to the accompanying drawings illustrating some embodiments of the invention.

DETAILED DESCRIPTION OF THE PREFERRED EMBODIMENTS

Figure 1:
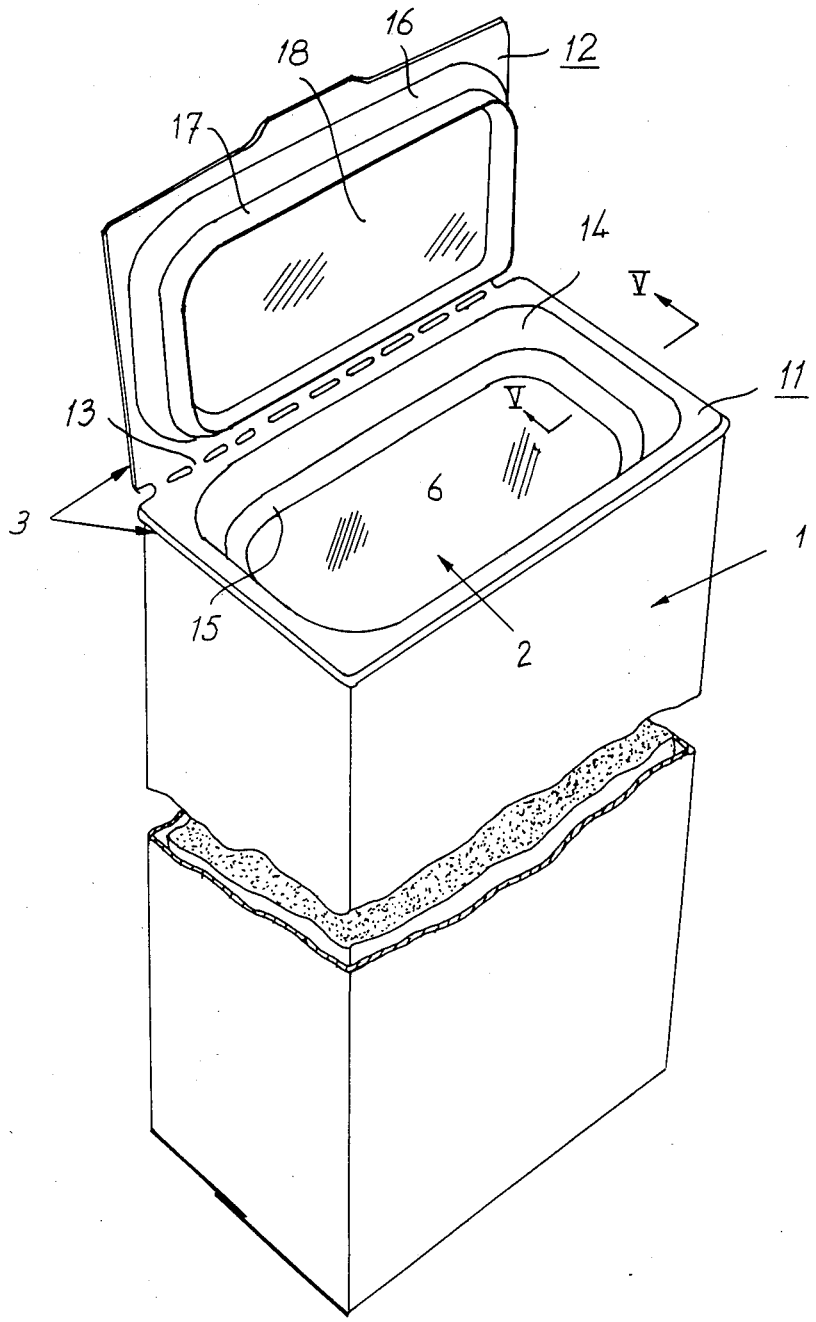
FIG. 1 is a perspective view of a container according to the invention with the lid folded up to an open position.
Figure 2:
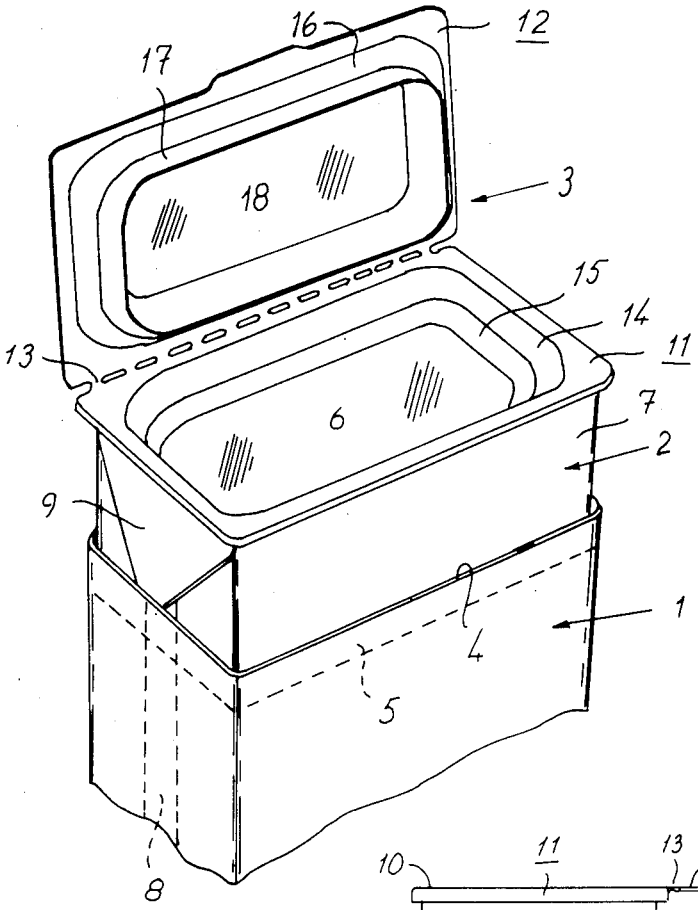
FIG. 2 is a perspective view of the upper part of the container shown in FIG. 1, with the reclosable lid means and the powder, liquid, gas or steam proof inner bag partly extracted from the outer container.
Figure 3:
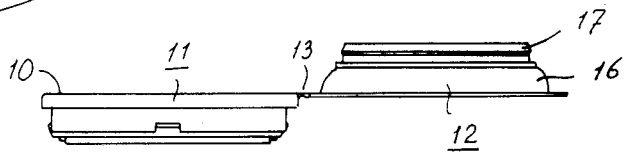
FIG. 3 is a side view of an embodiment of a reclosable lid means for a container according to the invention with the lid and the edge frame folded up from each other.
Figure 4:
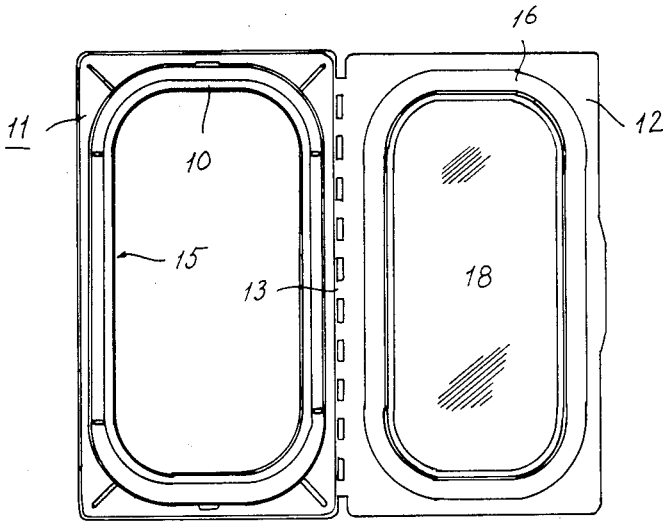
FIG. 4 is a plan view from underneath the lid of FIG. 3.

The reclosable container shown in FIGS. 1 and 2 generally comprises a supporting outer container 1 in the form of a sleeve made from a relatively stable supporting material, an inner bag or inner layer 2, which is preferably formed from a powder, liquid and gas or steam proof material, and a reclosable lid means 3.

The outer container mainly is intended to support the inner bag 2 and the reclosable lid means 3, and it can be made of any relatively stable material like cardboard or a plastic. As usual the outer container has a closed bottom (not shown), whereas it is open at the top 4, as best shown in FIG. 2. Preferably the outer container is made of cardboard from a flat punched container blank, which is folded and joined into a tube along one side or preferably along a corner to make it possible to close the container at the bottom. The container blank, as known per se, is formed with bottom closing flaps which are folded in and connected to each other. For strengthening the upper edge 4 of a portion of the margin adjacent the said upper edge can be double folded as shown at 5 in FIG. 5.

The inner bag 2 can be made of an easily flexed material that can be formed to a bag having a bottom, sides 7 and an open top. The bag can be made of any known suitable material like a plastic material, a plastic-aluminum laminate or any other powder, liquid, gas or steam proof material. The bottom of the bag, which will ultimately be inverted to form the top of the container, is preferably plain and formed without any seams to present a smooth surface portion. The bag is double folded and is joined along the two opposite side edges 8 and is formed with an even bottom having a suitable cross section form, for instance a rectangular cross section form as shown in the drawings. Each of the triangular ears 9 thereby formed adjacent the bottom 6 of the bag is folded up along its adjacent side. The bottom 6 of the bag when inverted is intended to provide the sealed inner top of the ready container. As is known per se the bag is filled and closed from what is initially its top, that is, from the bottom of the ready container and then sealed closed in known manner.

In order to provide a leak proof reclosing means for the container, it is important that the powder, liquid, gas or steam proof inner bag 2 is connected in sealed relation to the reclosable lid means 3. Preferably a large part of the bag is separate from the outer container 1, but if desired the bag can be point-glued to the outer container, for instance at or close to bottom of the container. To achieve the above mentioned sealed relation the reclosable lid means is formed with an even bottom surface 10 against which the smooth surface portion of the bag 2 is connected as will be described thereinafter.

The reclosable lid means 3 comprises a lid frame or edge frame 11 and a closing lid 12 which is connected to the lid frame 11 by means of a hinge 13. The lid frame is formed with a cavity 14 (FIG. 2) which includes a first lower portion constituted by a downward conically tapering sealing edge 15, best seen in FIG. 5. The sealing edge 15 at the bottom of the lid frame provides the above mentioned even bottom surface 10 which is of such width that the even bottom surface, that is, the upper smooth surface portion of the bag, when finally installed, can obtain a tight and strong sealed joint in relation to the lid frame. The closing lid 12 is formed with a cavity 16 having a configuration similar to cavity 14. The cavity 16 has a second lower portion in the form of sealing rib 17 which extends downwardly from the bottom of the cavity 16 and is adapted to seal against the sealing edge 15 of the lid frame. The closing lid 12 is also provided with an integral lid plane 18 extending across the lower edges of the sealing rib 17.

Figure 5:
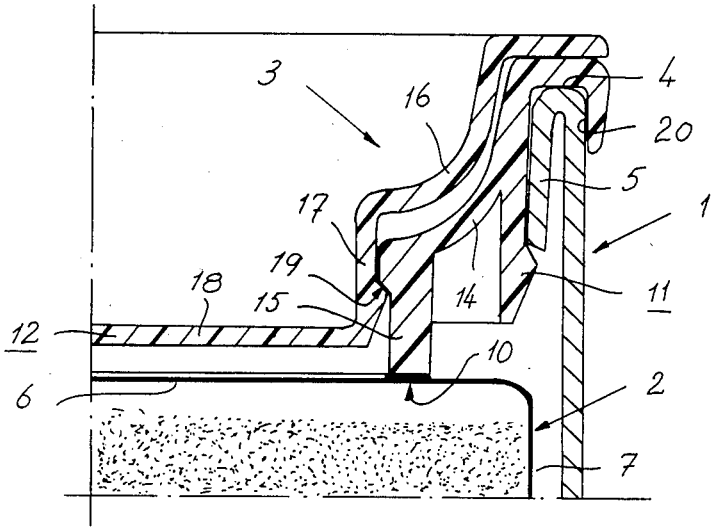
FIG. 5 shows an enlarged cross section view of a part of the container of FIG. 1 with the lid folded down, and taken along line V—V of FIG. 1.

As best shown in FIG. 5 the sealing edge 15 of the lid frame 11 and the sealing rib 17 of the closing lid 12 can be formed with cooperating means 19, for instance, bevelled edges or conical shoulders, for improving the tightness of the seal between the lid frame 11 and the sealing lid 12 and at the same time for providing a snap lock between the frame and the closing lid. Further, the lid frame 11 can be formed with an inversely U-shaped groove 20 in which the upper edge of the outer container can be introduced and secured, for instance by means of glue, wax or any other suitable means. It is, however, quite possible to eliminate the U-shaped groove 20 and to join the outer container 1 with the reclosable lid means 3 together with the inner bag 2 attached thereto, only against the outward facing side edge of the lid frame 11.

Figure 6:
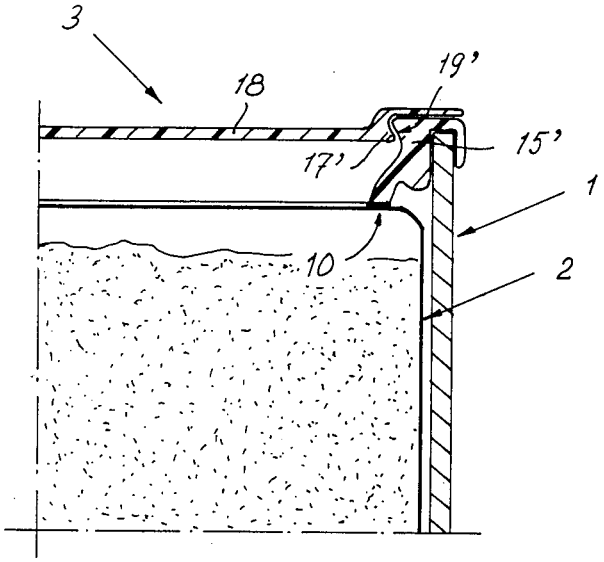
FIG. 6 is an enlarged cross section view similar to FIG. 5 showing a slightly varied embodiment of a reclosable lid means for the container.

FIG. 6 shows an alternative embodiment of a reclosing lid means which differs from the reclosing lid means of FIG. 5 mainly only in that the closing lid is adapted to seal and lock against the lid frame close to the upper edge thereof. For this purpose the sealing edge 15′ of the lid frame has been provided close to the upper edge, and correspondingly the sealing rib 17′ of the closing lid is provided on level with the lid plane 18.

By way of summarizing the assembly of the components shown in FIGS. 1 through 6, the outer container blank is formed into an open outer container tube 1, and then the reclosable lid means 3 is connected to the upper edge 4 of the outer container. Then the powder, liquid and gas or steam proof bag 2, which has been folded, joined along its sides and formed to the intended cross section form, is placed into the outer container 1 and attached, for instance welded, to the bottom surface 10 of the lid frame 11. Thereafter the container is turned upside down and is filled from the bottom side. The inner bag 2 is thus sealed and the bottom flaps (not shown) of the outer container 1 are folded in and are attached to each other. If found necessary, the bag 2 can be attached at points to the outer container, for instance by being point-glued or string-welded to the outer container at or adjacent the bottom thereof, so that the bag is maintained in a predetermined position in the outer container. The packed goods is hermetically enclosed in the bag, and the bag is opened in that the part of the bag bottom (top) 6 located inside of the sealing edge 15 of the lid frame 11, for instance by being cut through or by pulling open a tear open means. After opening, because of the sealed connection of the bag top 6 to the bottom surface 10 of the lid frame 11, the packed goods has no possibility of penetrating between the bag and the reclosable lid means or between the bag and the outer container, and when the closing lid 12 is reclosed the container is resealed thus providing a container which can be opened and reclosed to a sealed condition as required.

Figure 7:
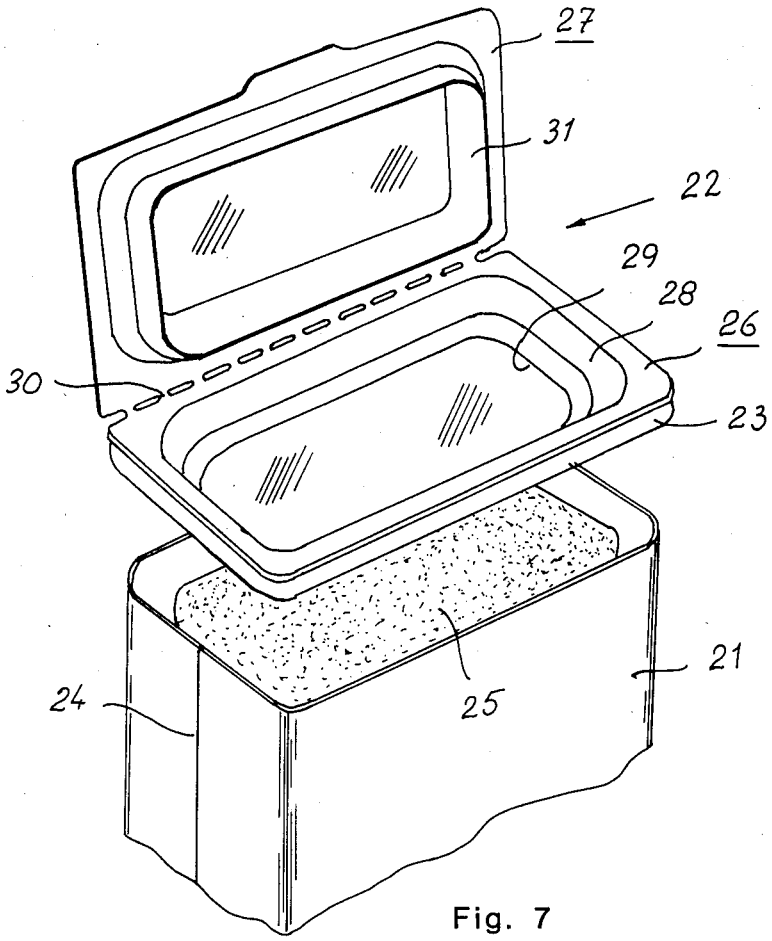
FIG. 7 is a perspective view of the upper part of a modified container according to the invention with the lid shown open for the sake of clearness and illustrated before the introduction thereof into the container sleeve.
Figure 8:
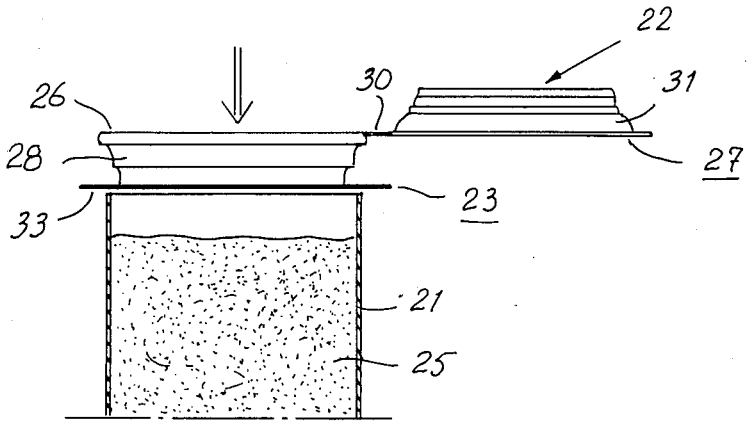
FIG. 8 is a side view, partially in section, in a smaller scale of the container shown in FIG. 7.
Figure 9:
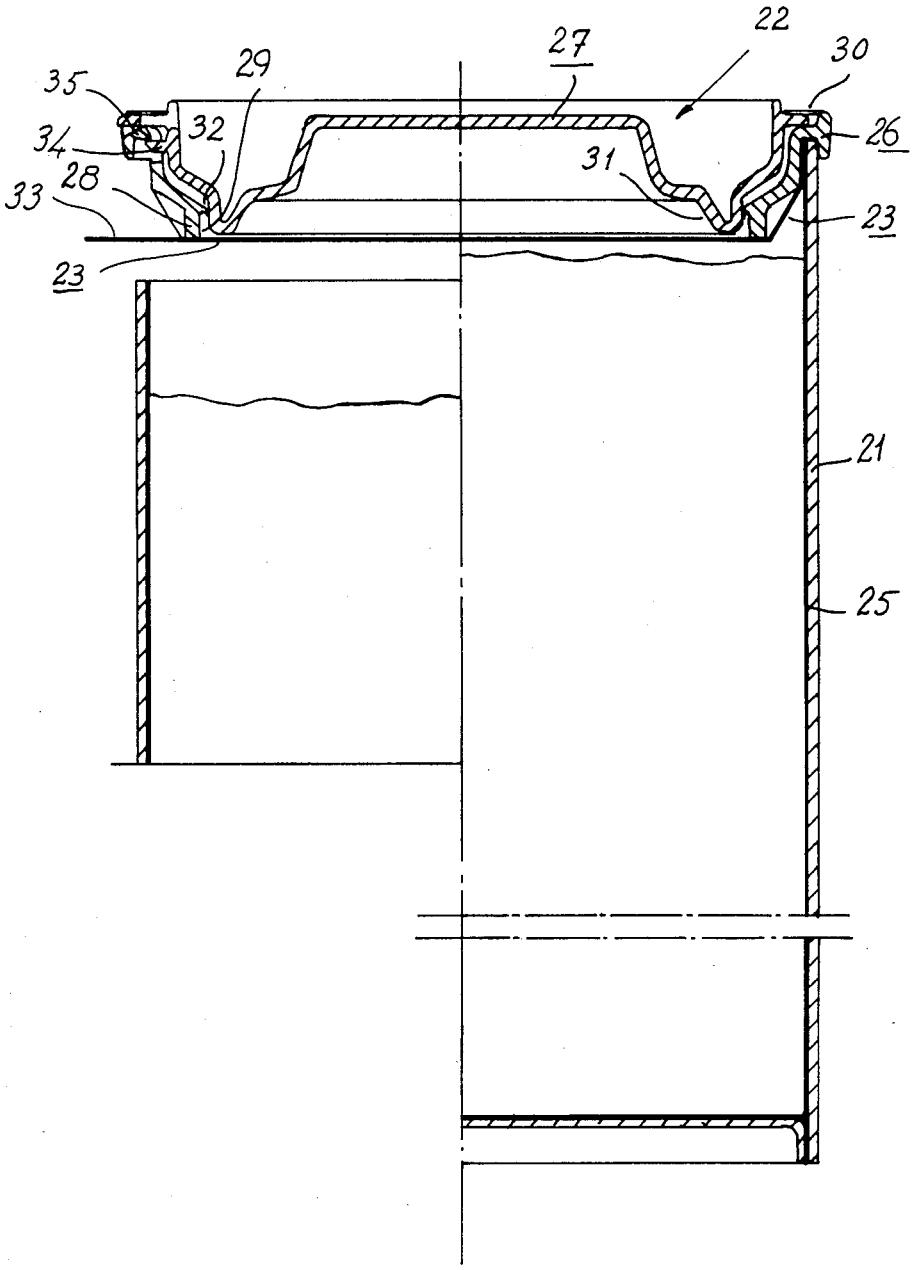
FIG. 9 is a diagrammatic cross section through the container with the left half thereof showing the reclosable lid means before introduction into the container sleeve and the right half thereof showing the reclosable lid means with the closing foil after it has been introduced in the container sleeve.

FIGS. 7–9 show another embodiment of the invention. The container illustrated in FIGS. 7–9 comprises a container sleeve 21 and a reclosable lid means 22 including a closing foil 23. The container sleeve 21 can be made of any stiff material like metal plate, or of any relatively stiff material like plastic, cardboard or a similar material. The container may be made from a flat, punched container blank which is formed into a tube having a rectangular cross section and rounded corners by being joined with an overlap joint or preferably a butt joint 24, for instance under cooperation with an inner (not shown) joining strip. The material of the container tube is, at least on the side thereof to become the inner side of the container, covered with a weldable material like a weldable resin material, which is powder, liquid, gas or steam proof. In case the different parts of the container are to be joined by means of high frequence welding, the material preferably is a triple laminate material, e.g., cardboard, an electromagnetically conducting intermediate layer like aluminum and an inner layer of a weldable plastic material.

The container is sealingly closed at the bottom, for instance by means of an inner cup-shaped bottom plate, see FIG. 9. The flange or rim of the bottom plate is weld connected to the inner layer of the sleeve. The container is shown as being filled with material 25 to a level which will leave space sufficient to permit introducing the reclosable lid means 22.

The reclosable lid means 22 (FIGS. 7, 8 and 9) comprise an edge frame 26 and a lid 27 which is connected thereto by a hinge 30. The edge frame 26 has a downwardly projecting first neck 28 which, in form and size, substantially coincides with the inner form and size of the sleeve 21, and which preferably is slightly conical. The neck 28 has an even bottom edge with a bottom surface which is suited for being weld connected or glue connected to a sealing foil 23 formed from a suitable weldable material. When the sealing foil is torn or cut open the neck 28 provides an opening 29 towards the packed goods 25. The lid 27 has a second neck 31 which is adapted to sealingly engage the first neck 28 of the edge frame, so that it is possible to reclose the lid 27 in the edge frame 26 under powder tight or preferably liquid, gas or steam tight conditions. As most clearly shown in FIG. 9, the edge frame 26 is, at the upper part of the first neck 28, formed with a circumferentially extending sealing lip 32 adapted to resiliently and sealingly engage the outside of the second neck 31 in an inwards-downwards curved form. Any gas pressure from inside the container will tend to press the sealing lip 32 more strongly and tightly against the sealing lip 32 of the second neck 31. The closing lid 22 can be formed with a snap lock as shown in the left part of FIG. 9, and which comprises a projecting hook 34 which snap engages underneath a shoulder 35 of the edge frame when the lid 27 is pressed down into the edge frame 26. The snap lock prevents the lid from being unintentionally opened. The lid can easily be opened by pulling the shoulder 35, which is slotted, lightly outwards.

As previously mentioned the sealing foil 23 is sealingly connected to the bottom surface of the edge of the frame neck 28. The sealing foil 23 projects laterally out from the frame a suitable distance for providing a fold-up sealing rim 33 which is adapted for engagement with the inner surface of the sleeve 21. When the reclosable lid means 22 with the sealing foil 23 is moved down into the sleeve 21 the laterally projecting part 33 of the sealing foil is folded up and is pressed into contact with the inner surface of the sleeve 21. The edge flange or rim 33 is adapted to be sealingly secured to the inner layer of the sleeve by means of gluing or welding. A preferred method of securing the sealing foil 23 is by means of high frequence (HF) welding (or ultrasonar welding), and for this purpose the sealing foil can be a laminate of a HF receiving aluminum layer facing the edge frame and a weldable plastic layer facing the sleeve. The foil alternatively can be a tripple laminate of plastic-aluminum-plastic, so that the sealing foil can be welded to the edge frame neck 28 and concurrently therewith to the inner surface of the tube. The sealing foil may, in conventional manner, be formed with a tear-open means for convenient exposing of the packed goods 25, or the sealing foil may otherwise be cut open by means of a knife. In both cases a sealed joint remains between the edge frame neck and the inner surface of the sleeve or tube 21. Because the lid forms an effective seal with the edge frame, the container can be reclosed to be powder, liquid, gas and even steam tight.

The initial assembly of the reclosable lid means 22, with the sealing foil 23 attached thereto, into the sleeve 21 can be made by means of a simple press fit of the outer edge frame neck 28 into the upper part of the tube 21. The initial assembly can also be made by means of a press plunge which is placed in the opening 29 of the edge frame and which can be formed with an expandable means for pressing the neck 28 with the fold-up sealing rim 33 laterally outwards into contact with the inner surface of the tube 21 during the glue or welding operation.

Figure 10:
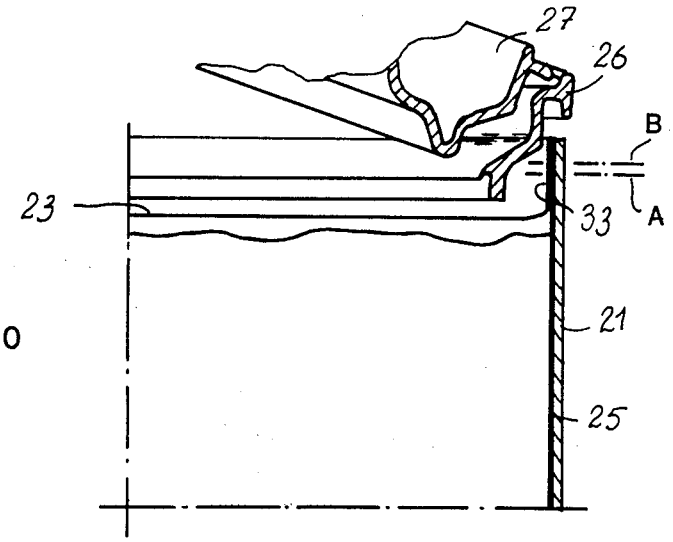
FIG. 10 is a cross sectional view of a first alternative method of connecting the sealing foil and reclosable lid means to the container sleeve.

FIG. 10 shows a first alternative method of manufacturing the container, whereby the sealing foil 23, in a first step "A", is weld connected to the inner surface of the sleeve 21 at the fold-up sealing rim 33, whereafter the edge frame 26 is introduced into the open end of the sleeve and is weld connected to the sealing rim 33 of the sealing foil in a separate second step "B".

Figure 11:
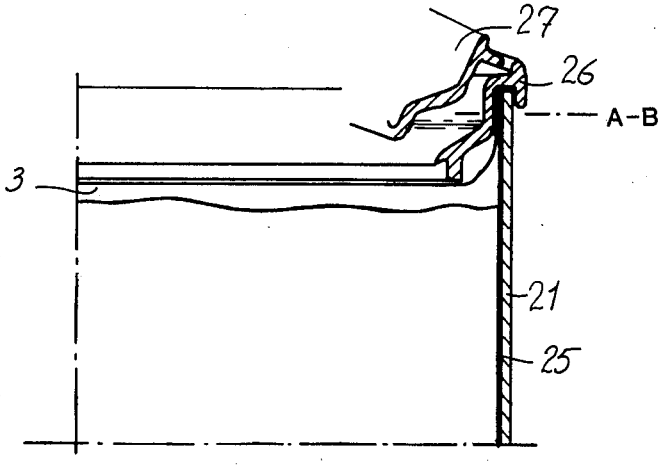
FIG. 11 is a cross sectional view of a second alternative method of connecting the sealing foil and reclosable lid means to the container sleeve.

FIG. 11 shows a second alternative method, in which the edge frame 26 and the sealing foil 23, like in FIG. 10, are separate from each other but in which the frame and foil are placed together, pressed through the open end of the sleeve 21 and then weld connected to the inner surface of the sleeve and to the sealing rim 33 of the sealing foil 23 concurrently and in one and the same operation A-B.

Figure 12:
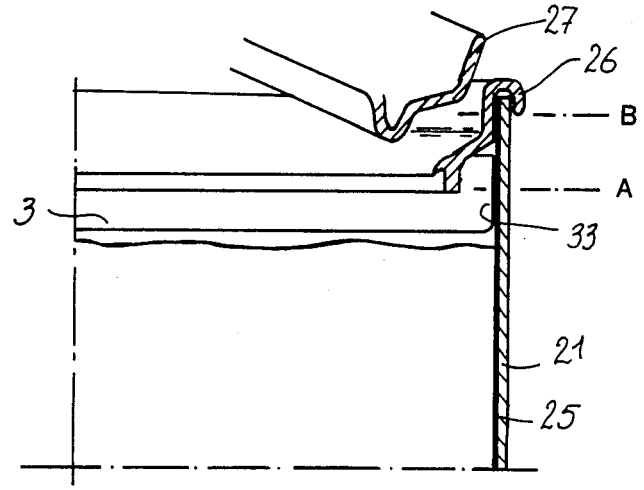
FIG. 12 is a cross sectional view of a third alternative method of connecting the sealing foil and reclosable lid means to the container sleeve.

FIG. 12 shows a third alternative, in which the sealing foil 23 and the edge frame 26 are also separate from each other, and in which they are weld connected to the inner surface of the sleeve 21 in two steps A and B. In this third alternative the edge frame 26 is positioned a slight distance above the upper terminal edge of the foil 23, so that both the foil and the edge frame are sealed directly to the gas tight inner layer of the sleeve.

FIG. 12 also indicates that the reclosing lid 27 does not need to be connected to the edge frame by a hinge, but can be a separate element.

It is to be understood that the embodiments of the invention which are shown in the drawings and which have been described are only illustrative examples, and that many alternative solutions, within the scope of the appended claims, may be suggested thereby to those skilled in the art

What is claimed as the invention is:

1. In a reclosable container which is powder, liquid, gas or steam proof before being opened and which, after having been opened, is adapted for being reclosed to become powder, liquid, gas or steam tight, and which comprising an outer container sleeve (1; 21) of a supporting material, an inner bag (2) or an inner layer on said container sleeve of a power, liquid, gas or steam tight material and a reclosable lid means (3; 22) comprising a lid frame (11; 26) adapted to be connected to the container sleeve (1; 21) and a closing lid (12; 27) adapted to be connected to the lid frame (11; 26), the improvement comprising said inner bag (2) or the inner layer of the container sleeve being connected in powder, liquid, gas or steam proof relation to said lid frame (11; 26), and in that said closing lid (12; 27) is adapted to be opened relative to the lid frame and after being opened is adapted to be reclosed in powder, liquid, gas or steam tight relation to said lid frame (11; 26).

2. A container according to claim 1, wherein the lid frame (11; 26) and the closing lid (12; 27) are formed with cooperating means for making it possible to reclose the inner bag (2) or layer under powder, liquid, gas or steam tight conditions, said cooperating means comprising a first lower portion (14; 28) including a sealing edge (15) at the bottom of the lid frame (11; 26) and a correspondingly formed second lower portion (16; 31) on the closing lid (12; 27) including a downwardly projecting sealing rib (17; 33) adapted to cooperate with the sealing edge (15) of the lid frame (11) when the sealing lid (12; 27) is closed, said sealing edge (15) of the lid frame (11) and the sealing rib (17; 33) of the closing lid (12; 27) being formed to have a sealing and locking means (19), for providing the sealing property and at the same time providing a snap lock between said lid frame and closing lid.

3. A container according to claim 2, wherein said locking means (19) comprises a bevelled edge on said lid frame (11; 26) and a mating bevelled edge on said closing lid (12; 27).

4. A container according to claim 1, wherein the lid frame (26) is formed with an inwardly facing sealing lip (32) adapted to resiliently and sealingly engage a downwardly projecting neck (31) of the lid (27) when the lid is closed, and wherein the lid is adapted to be secured to the edge frame (26) when the lid is closed by means of a snap lock (34; 13) (FIG. 9).

5. A container according to claim 1 having a separate inner bag (2) wherein the inner bag (2) is completely or partly free from the outer container (1), and wherein said lid frame (11) has an even bottom surface (10) extending therearound of such width that the inner bag (2) can be sealingly connected to the said bottom surface (10).

6. A container according to claim 1 in which the container sleeve (21) has an inner layer of a powder, liquid, gas or steam proof material, wherein a sealing foil (23) is connected in sealed relation to said inner layer of the container tube (21), and wherein said lid frame (26) is directly or indirectly connected in sealed relation to said sealing foil (23).

7. A container according to claim 6, wherein said frame (11) has an even bottom surface (10) with said sealing foil (23) connected in sealed relation to said inner layer of said container tube and to said even bottom surface (10), and wherein said sealing foil has a rim 33 projecting laterally outside and all around said lid frame (26), said rim (33) being folded up into contact with said sleeve inner layer after said reclosable lid means together with the foil (23) has been pressed through the open end of the container sleeve (21).

8. A container according to claim 7, wherein said sealing foil (23) is connected in sealed relation to said inner surface of the sleeve (21) at the same time as the lid frame (26) is sealingly connected to the inner surface of the folded up sealing foil rim (33).

9. A container according to claim 6, wherein the sealing foil (23) is separate from the lid frame, and wherein said sealing foil and said lid frame (26) are connected in sealed relation to the inner layer of said sleeve in two successive steps.

10. A container according to claim 6, wherein said sealing foil (23) is connected in sealed relation to said inner layer of said sleeve in spaced relation to said lid frame (26) and its point of sealed connection with said inner layer of said sleeve.

11. A container according to claim 6, wherein said sealing foil (23) is permanently secured to said lid frame, prior to installation to provide an integral, separate unit adapted to be introduced in a bottom-closed and filled container sleeve (21).

12. In a powder proof, reclosable container, which is liquid and gas proof before being opened and which, after having been opened, is adapted for being reclosed to become powder or gas tight, and comprising an outer container (1) of a support material, an inner bag (2) of, for instance, a liquid or gas proof material and reclosable lid means (3) comprising a lid frame (11) adapted to be connected to the outer container (1) and a closing lid (12) which is hinge connected to the lid frame (11), the improvement comprising said inner bag (2) being completely or partly free from the outer container (1) but having an even side thereof presenting a smooth surface portion that is connected in sealed relation to the lid frame.

13. A container according to claim 12, wherein said lid frame (11) is formed with an even bottom surface (10) around the frame opening of such width that said smooth surface portion of said inner bag (2) can be connected in sealed relation to said surface edge (10).

14. A container according to claim 12, wherein said lid frame (11) and the closing lid (12) are formed with cooperating means (19) for making it possible to reclose the inner bag (2), which is connected to the bottom surface (10) of the lid frame (11), under powder or gas tight conditions.

15. A container according to claim 14 wherein said lid frame (11) is formed with a first lower portion (14), which at the bottom thereof terminates in a sealing edge (15), and wherein said closing lid (12) correspondingly is formed with a second lower portion (16) which at the bottom thereof terminates in a downwardly extending sealing rib (17) adapted to cooperate with the sealing edge (15) of the lid frame (11) when the sealing lid (12) is closed thereby providing powder or gas tight reclosing of the container.

16. A container according to claim 15, wherein said sealing edge (15) of said lid frame (11) and said sealing rib (17) of the closing lid (12) are formed with cooperating sealing and locking means (19), including bevelled edges, for improving the sealing property and providing a snap lock between said lid frame and closing lid.

17. A container according to claim 1, wherein said outer container (1) has an even upper edge (4) and wherein said lid frame has an inversely U-shaped groove (20) into which said upper edge (4) is secured.

18. A container according to claim 1, wherein said outer container (1) has an even upper edge (4), and said lid frame has an outward facing side edge, and wherein said even upper edge is secured to said side edge.

* * * * *